United States Patent [19]

McKiernan et al.

[11] Patent Number: 4,893,720

[45] Date of Patent: Jan. 16, 1990

[54] TILTING SANITARY TANK

[75] Inventors: Edward F. McKiernan, Big Prairie; Carl E. Bochmann, Brecksville, both of Ohio

[73] Assignee: Sealand Technology, Inc., Big Prairie, Ohio

[21] Appl. No.: 312,169

[22] Filed: Feb. 21, 1989

Related U.S. Application Data

[63] Continuation-in-part of Ser. No. 252,797, Sep. 30, 1988, abandoned.

[51] Int. Cl.[4] ..... B65D 90/00

[52] U.S. Cl. ..... 220/5 A; 220/1 T; 280/47.26

[58] Field of Search ..... 220/1 A, 1 T, 5 A; 280/47.26

[56] References Cited

U.S. PATENT DOCUMENTS

| | | | |
|---|---|---|---|
| 3,385,521 | 5/1968 | Ballu | 220/5 A |
| 4,450,974 | 5/1984 | Snyder et al. | 220/1 T |
| 4,600,113 | 7/1986 | De Mars | 280/27.26 |
| 4,609,117 | 9/1986 | Pamment | 220/1 T |
| 4,775,070 | 10/1988 | Williams | 220/5 A |

OTHER PUBLICATIONS

Vasserkanister Catalog pages.
Thetford Cassette Porta-Potti brochure, 1987.
H&H Engineering advertisement "H&H Tote-Along".
Camping World, Snowbird 1987, p. 68.
Halt & Trinkwasser publication advertisement.
Fiamma advertisement, p. 21.

*Primary Examiner*—Joseph Man-Fu Moy
*Attorney, Agent, or Firm*—Nixon & Vanderhye

[57] ABSTRACT

The emptying of the contents of a holding tank for a recreational vehicle or the like into a land based water closet is greatly simplified, and made much less unpleasant. A portable tank has wheels at one end and a handle at the other, with a discharge valve located adjacent the handle. A deployable stationary support is provided with the tank. The deployable support includes collars engaging stub shafts extending outwardly from the sides of the tank, and two sets of legs which provide a supporting base. As the tank is moved into a vertical position it moves to a point where it is no longer supported by the wheels, but instead is supported by the legs, and the connection between the tank and the legs is automatically unlatched. The tank is then tilted (pivoted) about a horizontal axis so that the discharge valve is right above a water closet. A tube extends from the valve into the toilet to about the point of the liquid level. The valve is then opened from an area adjacent the wheels, and the contents of the tank are discharged into the water closet with a minimum of splashing and in a manner that automatically prevents overflow of the water closet. A pop up level indicator and manually operated vent are also preferably provided in the tank.

22 Claims, 4 Drawing Sheets

TILTING SANITARY TANK

CROSS-REFERENCE TO RELATED APPLICATION

This application is a continuation-in-part of application serial number 07/252,797 filed Sept. 30, 1988, now abandoned.

BACKGROUND AND SUMMARY OF THE INVENTION

Recreational vehicles, and the like, typically have toilets on board that are associated with holding tanks for holding the wastes "flushed" down the toilet. Periodically the holding tanks must be emptied. While this does not cause a significant problem if there are campsites, or like facilities, available which have pumps and connections for emptying the holding tanks. However in different parts of the world, and in remote areas of the United States, where the appropriate facilities do not exist, there can be great difficulties in properly (without polluting the environment) disposing of the waste water from the holding tanks.

Various products are on the market for allowing the contents of a holding tank to be discharged into a separate, transportable tank. The transportable tank is then wheeled, or otherwise transported, to a land based water closet, or the like, and the contents of the transportable tank emptied into the land based water closet. However existing transportable tanks are difficult to handle during the discharge of the waste water therefrom into the land based water closet, can result in a great deal of splashing, can cause overflow of the water closet if the water closet level is not reduced quickly enough by periodic flushing, and in general cause the discharge task to be a most unpleasant and difficult one.

According to the present invention, a tank system is provided which overcomes the majority of the drawbacks associated with prior art transportable tanks. According to the present invention, it is possible to readily and easily position the transportable tank at the land based water closet or the like so that discharge of its contents into the water closet is simple and easy to accomplish. Further, by locating the actuator for the discharge valve associated with the transportable tank as far as possible from the discharge valve itself, the job of emptying the transportable tank can be made less unpleasant. Also, according to the present invention splashing is minimized during emptying of the transportable tank, and the tank system is designed so that overflow of the water closet is inherently prevented.

According to one aspect of the present invention there is provided a method of emptying the holding tank in a recreational vehicle or the like, and discharging the contents of the holding tank into a water closet or the like, utilizing a wheeled transportable tank having a discharge valve with actuator, and a deployable stationary support operatively connected to the transportable tank. The method comprises the following steps: (a) Filling the transportable tank with the contents of the recreational vehicle holding tank by opening the valve of the transportable tank and flowing the contents of the holding tank through it, and then closing the valve. (b) Wheeling the transportable tank, on its wheels, to a water closet or the like. (c) At the water closet or the like, deploying the stationary support, so that it supports the transportable tank instead of the wheels. (d) Tilting the transportable tank with respect to the stationary support about a horizontal axis to move the discharge valve into a position just above the water closet or the like. And, (e) actuating the discharge valve to allow the contents thereof to flow therethrough into the water closet or the like. During the practice of step (a) a vent, preferably located in the same face as the discharge valve, is manually opened, and during the practice of steps (d) and (e) the manual vent is closed. Further, a tubular element is provided from the discharge valve extending into the toilet, and no vent (with the manual vent closed) is provided for the tank except through the discharge valve itself. Therefore, once the level of liquid in the toilet reaches the tube extending from the valve, a vacuum results in the tank, insuring that no further liquid will be discharged from the tank into the toilet until the liquid level in the toilet drops below the tube. The tube also minimizes splashing of waste water being discharged into the water closet.

According to another aspect of the present invention a transportable tank system for handling waste water and the like is provided. The system comprises the following components: A tank body having first and second opposite ends, and first and second opposite faces between the first and second ends. Discharge valve means provided in the tank first face for selectively providing or preventing fluid communication between the interior of the tank and the exterior thereof. Wheel means provided as the second end of the tank for mounting the tank for rolling movement. And, tilting means for mounting the tank for tilting movement from a first position, in which the tank is transportable by the wheel means with the wheel means engaging the ground and supporting the tank, to a second position in which the wheel means do not support the tank, and the discharge valve means is elevated with the first face extending substantially horizontally so that it may be disposed directly over a toilet to discharge the contents of the tank into the toilet. The tilting means preferably comprises support legs and bearing means connected to the support legs. The bearing means comprises a pair of stub shafts extending outwardly from the sides of the tank, and collar means integral with the legs receiving the stub shafts and pivotal with respect to the shafts, the shafts defining a horizontal axis about which the entire tank pivots. The support legs preferably comprise first and second support legs rigidly connected to the collar means and extending therefrom outwardly past the first end of the tank, and third and fourth legs pivotally connected to the first and second legs for movement between a nonuse position in which the third and fourth legs are substantially parallel to the first and second legs, to a use position in which the third and fourth legs make a positive angle with respect to the first and second legs and thereby provide a support base for supporting the tank for pivotal movement about the horizontal axis defined by the shaft stubs. Latching means are also associated with the tilting means for releasably latching the tilting means to the tank in the first position thereof. The latching means comprises a hooked latching plate extending from at least one of the third and fourth legs toward the axle supporting the wheels, and shaped and dimensioned to engage the axle when the tank is in the first position, and to disengage the axle when the tank is in the second position. A handle is mounted on the second end of the tank for facilitating movement of the tank with the wheel means and tilting of the tank about the horizontal axis. If the tank is actually used itself in a recreational vehicle in place of the holding tank, or desirably even under other circumstances, a level indicator is built into the tank.

According to yet another aspect of the present invention, a tank system is provided which comprises: A generally parallelepiped shaped tank having first and second opposite ends, first and second opposite major faces and first and second opposite minor faces extending between the first and second ends. Wheel means operatively mounted to the tank adjacent the first end thereof. Handle means associated with the tank adjacent the second end thereof Discharge valve means provided in the first major face and adjacent the second end of the tank for selectively allowing or preventing discharge of liquid from the interior of the tank to the exterior thereof. And, actuator means for the discharge valve means including an actuator element mounted adjacent the first end of the tank, remote from the discharge valve means. A manually actuatable vent is also provided on the tank, and an anti-splash tube is connected to a discharge valve, and extends from the discharge valve toward the land based water closet.

It is the primary object of the present invention to provide a simple and effective transportable tank to facilitate emptying of holding tanks from recreational vehicles, or the like, into land based water closets, or the like. This and other objects of the invention will become clear from an inspection of the detailed description of the invention and from the appended claims.

DETAILED DESCRIPTION OF THE DRAWINGS

Figures 1, 4:
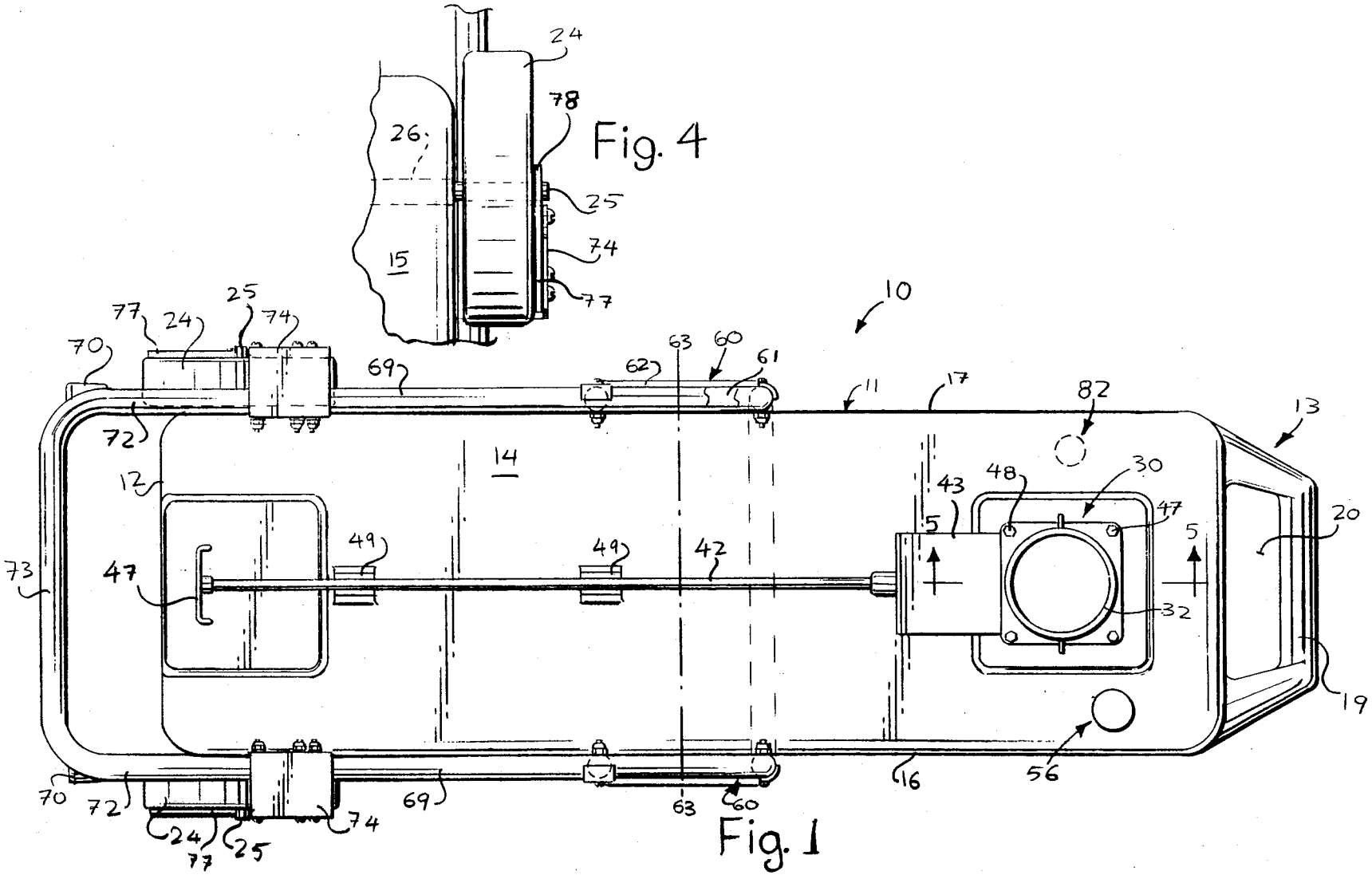
FIG. 1 is a top plan view of an exemplary transportable tank system according to the invention.
FIG. 4 is a detail end view showing the cooperation between the latching means and wheel axles of the tank system of FIGS. 1 through 3.
Figure 2:
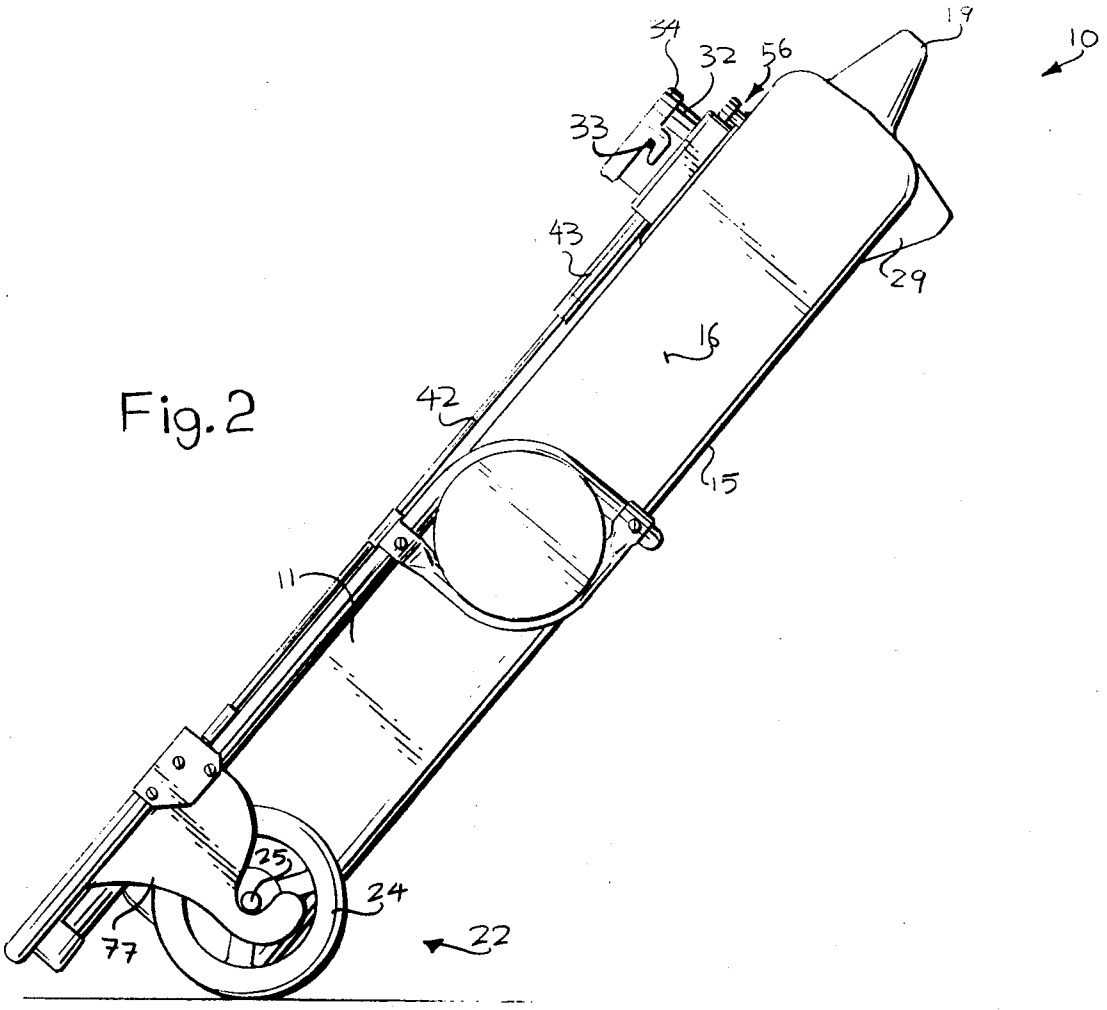
FIG. 2 is a side view of the tank system of FIG. 1 in the movement position thereof.
Figure 3:
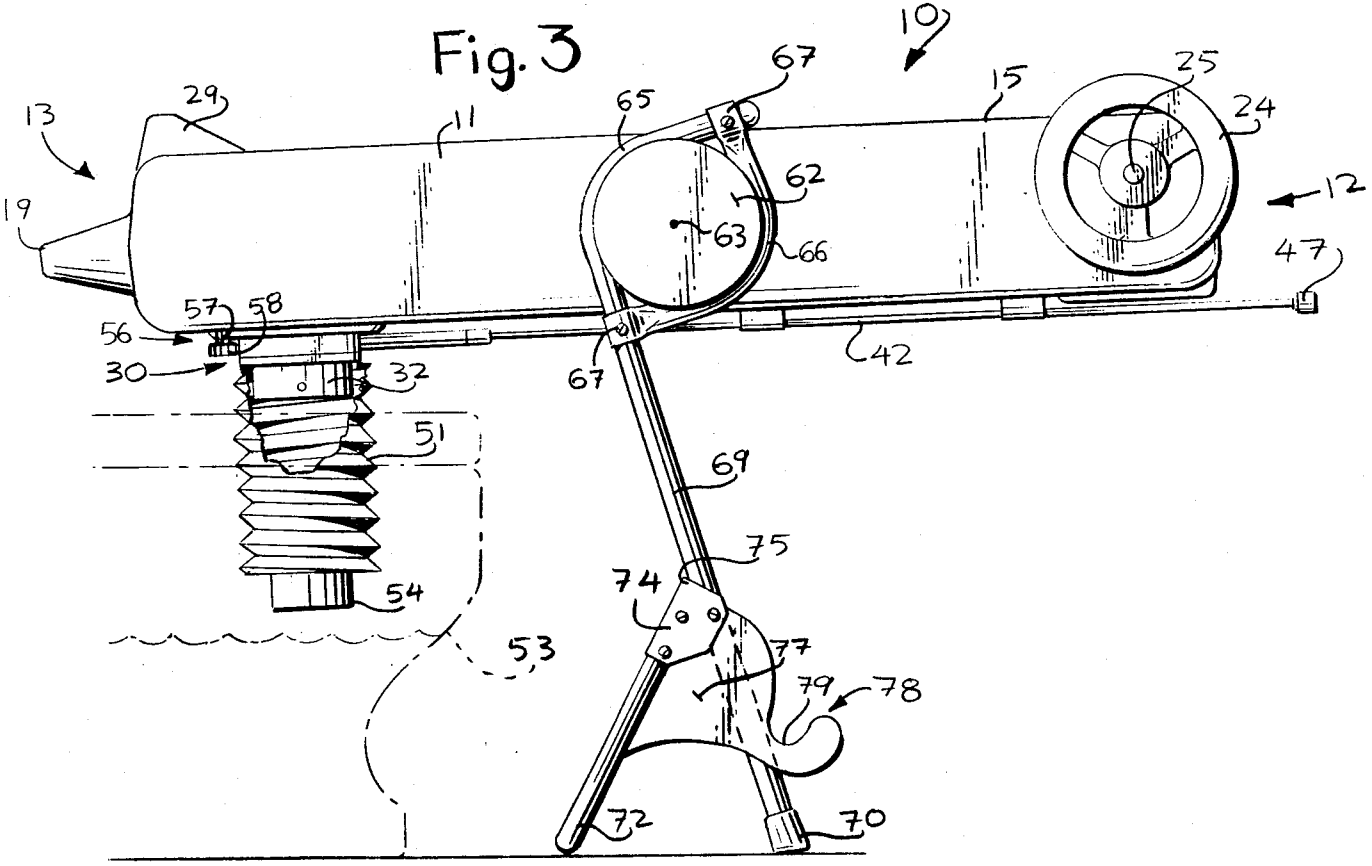
FIG. 3 is a side view of the tank system of FIGS. 1 and 2 in the discharge position thereof.

An exemplary transportable tank system according to the invention is shown generally by reference numeral 10 in FIGS. 1 through 3. The largest element of the system 10 comprises the tank 11. The tank 11 preferably is a plastic material, such as blow-molded or roto-cast polyethylene, and typically would have a capacity sufficient to allow at least a complete holding tank to be dumped therein (e.g. at least about 40 liters). The material of which the tank 11 is made must be sufficient to withstand the action of concentrated waste water, and formaldehyde deodorant and acidic cleaners. The tank 11 includes a first end 12 thereof, a second end 13, a first major (top) face 14, a second major (bottom) face 15, and first and second minor (side) faces 16, 17.

Preferably at the second end 13 of the tank 11 there is provided handle means, including a handle portion 19 which defines an opening 20 through which the user can place his/her fingers to grasp the tank. The handle 19 is preferably integrally molded with the rest of the tank 11. Mounted at the first end 12 of the tank 11 are wheel means, shown generally by reference numeral 22. The wheel means preferably comprise a pair of wheels 24 mounted by axle means, such as axle 25, to, or adjacent, the second face 15. An integral upstanding piece 26 (see FIG. 4) of a portion of the bottom face 15 adjacent the first end 12 may define a tubular passageway for receiving the axle 25, with the wheels 24 mounted on opposite ends thereof. Also extending downwardly from bottom face 15 there preferably is a stationary support leg 29 (see FIGS. 2 and 3) which is integral with the tank 11, and allows the tank 11 to rest securely on the ground, with the wheels 24 and stationary leg 29 engaging the ground, during filling of the tank 11.

Located on the top face of the tank 11 is discharge valve means, showing generally by reference numeral 30, for selectively preventing and allowing discharge of the contents of the tank 11, or filling of the tank 11 with liquid. The discharge valve means are shown generally by the reference numeral 30. Preferably, the discharge valve means include an upstanding collar 32. The collar may have pins 33 extending outwardly from the sides thereof for receipt of a slot in a cap 34. The cap 34 is manually placed on, or removed from, the collar 32 for cosmetic reasons and to prevent unnecessary contamination of or possible damage to the movable valve element, but does not do any actual valving. The cap 34 seen in place in FIG. 2, but is removed in the other figures.

Figure 5:
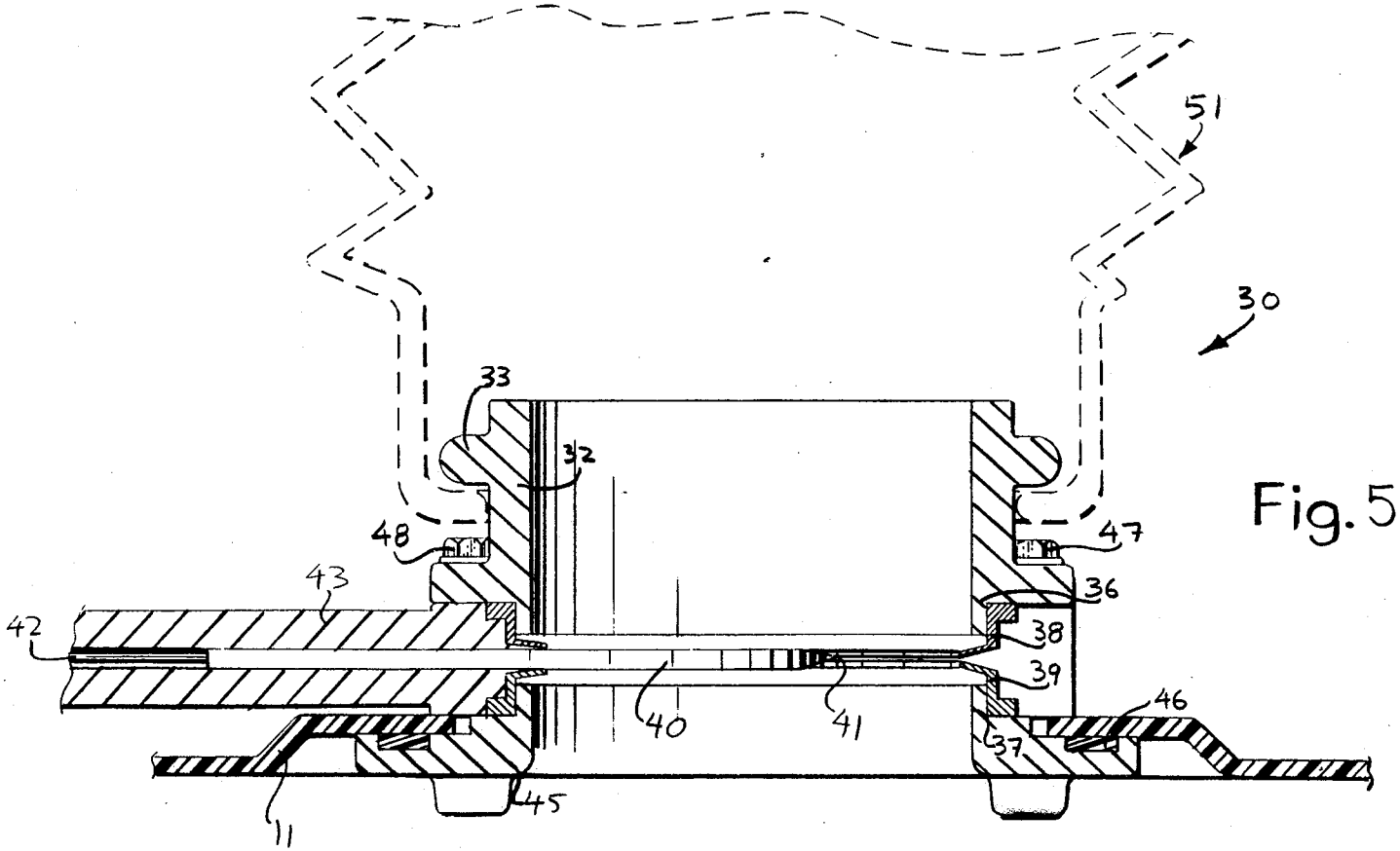
FIG. 5 is a cross-sectional view of the discharge valve means of the tank system of FIGS. 1 through 3.

As seen most clearly in FIG. 5, the valve means 30 includes stationary valve body portions 36, 37, the portion 36 comprising part of the collar 32. Connected to these stationary valve body portions 36, 37 are the stationary valve sealing elements 38, 39. Cooperating with these annular shaped sealing elements 38, 39 is a reciprocal movable valve element (plate) 40. The plate 40 is tapered to a point 41 at an end thereof most remote from an actuator rod 42, and is guided for reciprocal movement between open and closed positions by the valve body guide 43. The collar 32, valve body guide 43, and the like, are connected to the tank 11 by a clamp 45 disposed on the interior of the tank 11 (see FIG. 5) with a ring 46 of gasket material between the clamp 45 and the tank 11, and a plurality of screws 47 connecting the clamp 45 to the collar 32 and valve guide body 43.

The actuator rod 42 comprises part of actuator means for the discharge valve means 30, including a remote actuator element (knob) 46. According to the present invention, the rod 42 extends substantially the length of the tank 11 toward the first end 12 thereof, the discharge valve means 30 being mounted adjacent the second end 13, and is supported at predetermined points by supports 49 which allow reciprocation of the rod 42 with respect to the tank 11. The actuator element 46 is thus remote from the collar 32, being adjacent the first end 12 of the tank 11 while the collar 32 is adjacent the second end 13.

Also, in the discharge (FIG. 2) position of the tank 11, a tubular element 51 (shown in dotted line in FIG. 5 and solid line in FIG. 3) is utilized. This tubular element attaches to the collar 32, either with a friction fit or utilizing a connecting band, or other conventional mechanism for connecting it to the collar 32. The tube has sufficient length so that when it extends into a land based water closet or the like 53 (see FIGURE 3) it minimizes the splashing that occurs from discharge of the waste water from tank 11 into the water closet 53.

Also, it automatically acts as a sensing means for sensing the level of water in the water closet 53 and cutting off the discharging action from the tank 11 should that level of water in the toilet 53 rise high enough so that the danger of overflow occurs. Since—as will be explained in more detail hereafter—the only vent to the tank in the discharge position of FIG. 3 is provided through the tube 51 and collar 32 themselves, when the bottom end 54 of the tube 51 is closed off by liquid in the water closet 53, it is impossible for air to enter the tank 11, therefore a vacuum condition is created in the tank 11 that prevents further discharge of the liquid therefrom until the bottom end 54 of the tube 51 is again uncovered with liquid (as occurs when flushing the water closet 53).

The only vent for the tank 11 is the manual vent shown generally by reference numeral 56 in FIGS. 1 through 3. This vent merely comprises an upstanding plastic tubular portion integral with the tank 11, and having exterior screw threads on the top thereof. The exterior screw threads on the tubular element 57 cooperate with interior screw threads on a cap 58. Thus by screwing the cap onto the tube 57 the vent is closed. By removing the cap 58 the vent is opened. The vent means 56 is disposed in the same face, 14, of the tank 11 as the valve means 30.

In order to facilitate ease of discharge of the waste material from the tank 11 into a water closet 53 or the like, tilting means are provided. Such tilting means comprises deployable legs which provide a stationary support, and the tank 11 is rotatable about a horizontal axis with respect to the stationary support to allow the valve 30 to be moved into the discharge position of FIG. 3.

The details of the tilting means are best seen in FIGS. 1 through 4. A pair of shaft stubs 60 extend outwardly from the minor faces 16, 17 of the tank 11. The shaft stubs 60 comprise a main body portion 61 (see FIG. 1) and a larger end portion 62, the enlarged end portion 62 adapted to receive a collar means therebeneath (as will be more fully explained) to hold the collar means in place while relative rotation is allowed. The shaft stubs 60 are preferably integral with the tank 11, and define a substantially horizontal axis 63—63 about which the tank 11 is rotatable. Cooperating with the shaft stubs 60 is collar means defined by the first arcuate tube portion 65, and a second arcuate tube portion 66. Preferably both of the arcuate tube portions 65, 66 are circular in cross-section and constructed of hollow aluminum tubing. The ends of the second portion 66 are clamped, screwed, or otherwise attached, as indicated by reference numeral 67 in FIG. 3, to portions of the first arcuate portion 65. The collar means defined by the arcuate portions 65, 66, and the shaft stubs 60, together comprise bearing means. Also, a cross piece 68 is provided (see FIGS. 1 and 3 in particular), which provides a stop during tilting action of the tank.

Integral with the first arcuate portion 65 of each collar means is a support leg 69. The legs 69 preferably terminate in free end bottom portions thereof which are capped by rubber caps 70 or the like. The rubber caps 70 are adapted to engage the ground. The legs 69 are dimensioned with respect to the positioning of the shaft stubs 60 in a central portion of the tank 11 so that when the legs 69 are in the nonuse position, allowing wheeled transport of the tank 11 (FIG. 2), they extend past the first end 12 of the tank 11 a significant distance, as is clear in FIGS. 1 and 2.

The deployable support means for the system 10, in addition to including the legs 69, which comprise first and second legs, comprise third and fourth legs 72. The third and fourth legs 72 preferably are interconnected at the bottoms thereof by the cross-piece 73 (see FIG. 1), although they could terminate and have rubber end caps just like the legs 69. They are mounted by brackets 74 to the outside portions of the legs 69 with which they cooperate, with brackets 74 providing for pivotal movement of the third and fourth legs 72 with respect to the first and second legs 69 from a nonuse position (FIGS. 1 and 2) in which the legs 72, 69 are essentially parallel, to the deployed position illustrated in FIG. 3 in which the legs 72, 69 provide a secure base for supporting the system 10. In the position illustrated in FIG. 3, the end 75 of the bracket means 74 abuts the legs 69 to prevent further pivotal movement of the legs 72 with respect to the legs 69. The legs 72 extend further from the tank body than do the legs 69.

It is desirable to latch the legs 69 to the rest of the tank 11 during transport thereof, and movement of the tank 11 into the position at which the support may be deployed. One way that this can be accomplished is to utilize the hooked end latch plates illustrated in FIGS. 2 and 3. Such latch plates, which are provided with at least one of the legs 72, but preferably with both, include a main plate portion 77 which is affixed to the leg 72 on the outside thereof, and a hooked shaped end 78 containing a slot 79 for receipt of the axle 25. As can be seen in FIGS. 2 and 4, the plate 77 with hook 78 and slot 79, is dimensioned and shaped so that when the legs 69, 72 are parallel the axle 25 will be received in the slot 79. This will prevent the legs 69 from moving away from the top face 14 of the tank 11. When the legs 72, 69 are caused to pivot with respect to each other toward the position illustrated in FIG. 3, then the latch plate 77 is automatically moved away from the axle 25, and the hook 78 disengages it, so that the legs 69 are freed to rotate relative to the tank 11 about the bearing means provided by the shaft stubs 60 and the collar elements 65, 66. Plate 77 may move between tank 11 and wheel 24 or outside of wheel 24.

Once the legs are in the position illustrated in FIG. 3, the operator by grasping the handle 19, etc., and rotating the tank 11 about the axis 63, causes the face 14 to face downwardly [FIG. 3]. The legs 69, 72 will be deployed adjacent a toilet 53, and once the tank 11 is in a basically horizontal position the operator will grab the knob 46 connected to the actuator rod 42 and pull it toward him or her, causing the valve means 30 to open and the waste water therein to be discharged into the toilet.

Figure 6:
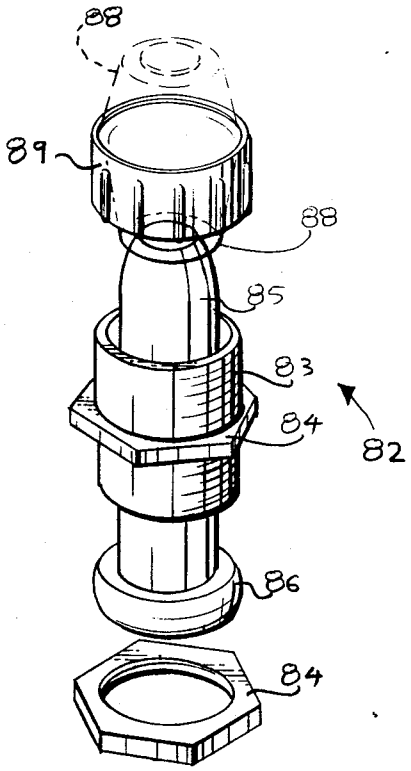
FIG. 6 is an exploded perspective view of an exemplary pop-up level indicator that can be utilized with the tank system of FIGS. 1 through 3.

Under some circumstances it will be desirable to use the tank 11 as a the actual holding tank in a recreational vehicle or the like, and connected to the toilet in the recreational vehicle or the like so that it may be readily detached. Especially in these circumstances, but also even in others where desired, a level indicator is provided for the tank 11. An exemplary level indicator according to the invention is shown generally by reference numeral 82 in FIG. 6. The level indicator 82 preferably will be positioned as illustrated in dotted line in FIG. 1, that is on the face 14, on the opposite side of the valve means 30 from the vent 56.

The level indicator 82 includes an exteriorly threaded mounting tube 83 which is adapted to cooperate with mounting nuts 84 which will engage opposite faces of the tank 11 (that is one inside and one outside the tank).

Reciprocally mounted within the tube 83 is a float stem 85 having a bulb 86, or other buoyant element, on the bottom end thereof. The lower nut 84 will of course be above the bulb 86 in use. The top of the float stem 85 is preferably connected to the bottom surface of a rubber diaphragm 88 which is connected on the annular periphery thereof to a plastic cap 89. The cap 89 is screw threaded on the outside of the mounting tube 83. When there is a relatively low level of liquid in the tank 11, the float 85 will move downwardly, causing the diaphragm 88 to assume the solid line position in FIG. 6. However when the level of liquid gets high, the float 85 will push the diaphragm 88 so that it snaps over center to the dotted line position in FIG. 6. Preferably the diaphragm 88 is brightly colored (e.g. red) and then is readily visible when it upstands from the cap 89 as indicated in the dotted line position in FIG. 6. At this point the operator knows to stop adding waste water to the tank 11, as by pushing the rod 42 in so as to close the valve means 30.

Operation

In the utilization of the tank system 10 according to the present invention to empty a holding tank in a recreational vehicle or the like, the operator wheels the tank 11 on the wheels 24 to a position adjacent to the holding tank. A hose is placed over the collar 32 and to a similar connection on the discharge valve of the holding tank, and then the valve associated with the holding tank is open, and the handle 46 of the actuator rod 42 is grasped and moved away from the end 13 of the tank 11, to cause the movable valve element 40 to move away from complete sealing engagement with the seals 38, 39, and thereby allow the waste water from the holding tank to flow through the valve means 30 into the transportable tank 11. Once the diaphragm 88 pops to the upright, dotted line position in FIG. 6 (or where the pop up level indicator 82 is not utilized and the filling of the tank 11 is otherwise determined), the discharge valve on the holding tank is closed, the handle 46 is grasped and the rod 42 pushed toward the end 13 so that the valve element 40 closes off the opening in the collar 32, and thus the discharge valve means 30 of the tank system 10 is closed. Then the hose is disconnected, and the operator lifts on the handle 19 to move the stationary leg 29 (which had been supporting the tank 11 on the ground) off the ground, so that the tank 11 is supported solely by the wheels 24 in the position illustrated in FIGURE 2. At this time, with the bottom surface 15 of the tank 11 making an angle of approximately 50° with respect to the ground, the operator engages the handle 19 and drags or pushes the tank 11 to a land based water closet 53 or the like (FIG. 3).

During the time that the tank 11 is being filled, the cap 58 has been unscrewed from the upstanding tube 57 so that the vent 56 is open. After filling is completed, the cap 58 is screwed back on the upstanding tube 57 so that the vent 56 is closed.

The tubular element 51 is connected onto the collar 32 (the cap 34 therefor having been removed), with the end 54 of the tube 51 away from the tank 11.

Once the operator reaches a position adjacent the water closet 53, so that the wheels 24 are a few inches in front of the water closet 53, the operator pivots the handle 19 upwardly so that the tank is moved into a vertical position. When the operator does this, the tip 70 of the legs 69—since they extend out past the end 12 of the tank 11, will engage the ground and support the tank. Continued movement causes the cross-piece 73 of the legs 72—which also are engaging the ground at that time and extend even further than the legs 69 away from the first end 12 of the tank 11—are also automatically deployed, pivoting about the bracket 74 with respect to the legs 69 until the edges 75 of the bracket 74 abut the legs 69 (the FIG. 3 position). As the legs 72 are being pivoted with respect to the legs 69 by this action, the latching plate 77 is moving with respect to the axle 25 so that the slot 79 in hooked end 78 no longer engages the axle 25, so that now the tank 11 may be tilted with respect to the legs 69. Then the operator, continuing to push on the handle 19 and/or engaging the wheels 24 and lifting up on them, rotates the tank 11 about the horizontal axis 63 causing the tank 11 to rotate via bearing means (provided by stub shafts 60 and collar elements 65, 66) so that the face 14 of the tank 11 is substantially horizontal and faces downwardly, with the valve means 30 disposed over the water closet 53.

The tilting of the tank action is automatically stopped by the frame cross piece 68 in the position illustrated in FIG. 3. That position is slightly past horizontal, and in that position, full drainage is ensured. Also, in this position the center of gravity is slightly biased toward the valve end so that the tank body 11 stays against stop 68. The stop 68 also protects the porcelain of the toilet 53 from the weight of the tank 11 and its contents.

Once the valve means 30 and tube element 51 reach the position illustrated in FIG. 3, the operator grasps the knob 46, and pulls on it so that it moves away from the second end 13 of tank 11, thereby again causing the movable valve element 40 to disengage the stationary seals 38, 39, and open the discharge valve 30. The contents of the tank 11 then start flowing into the water closet 53. The water closet 53 is periodically flushed. Should the level of liquid in the water closet 53 rise above the open bottom 54 of the tube 51, then no air can enter the tank 11 (since it is—except for the opening through collar 32—otherwise air tight, and therefore the flow of liquid from the tank 11 into he water closet 53 is terminated. After the liquid level in the water closet 53 moves down past the bottom of the tube end 54, the flow of waste water from the tank 11 into the water closet 53 continues. The tubular element 51 minimizes splashing, and since the operator is as remote as possible from the water closet 53 during this operation and since he/she need not worry about overflow, a minimum of unpleasantness is associated with this task.

Once the contents of the tank 11 have been fully discharged into the water closet 53, the operator pushes down on the wheels 24 to push them toward the legs 69, ultimately grabs the handle and tilts the tank 11 backwardly so that the face 15 starts moving toward the ground, and in doing this he/she automatically disengages the legs 69, 72 from the ground. While it is likely that the plates 77 will automatically engage and lock the axle 25, if they do not the operator need only—with his/her hand or foot—push on the legs 72 to move them closer to the legs 69, thereby causing a latching action. The tank 11 is then ready to be wheeled back—supported by the wheels 24—to a storage area, or perform another holding tank emptying operation. Further, the tank 11 may be cleaned by putting in a formaldehyde deodorant or acidic cleaner in the tank 11, pivoting back and forth to slosh the cleaner around, and then emptying it (as into a water closet as described above).

It will thus be seen that according to the present invention a simple yet effective method and apparatus have been provided for discharging the waste water from a holding tank associated with a recreational vehicle or the like, into a land based water closet or the like. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A transportable tank system for handling waste water and the like, comprising:

a tank body having first and second opposite ends, and first and second opposite faces between said first and second ends;

discharge valve means provided in said tank first face for selectively providing or preventing fluid communication between the interior of the tank and the exterior thereof;

wheel means provided at said first end of said tank for mounting said tank for rolling movement; and tilting means operatively connected to said tank for mounting said tank for tilting movement from a first position, in which said tank is transportable by said wheel means with said wheel means engaging the ground and supporting said tank, to a second position in which said wheel means do not support said tank, and said discharge valve means is elevated with said first face extending substantially horizontally so that it may be disposed directly over a toilet to discharge the contents of the tank into the toilet.

2. A system as recited in claim 1 wherein said tilting means comprises support legs, and bearing means for operatively connecting said support legs to said tank to provide for pivotal movement of said tank about a substantially horizontal axis when supported by said support legs.

3. A system as recited in claim 2 wherein said bearing means comprises a pair of stationary shaft stubs extending outwardly from opposite sides of said tank between both said first and second ends and said first and second faces and defining said horizontal axis, and collar means surrounding said shaft stubs and connected to said support legs.

4. A system as recited in claim 3 wherein said support legs comprise first and second legs rigidly connected to said collar means and extending therefrom outwardly past the first end of said tank, and third and fourth legs pivotally connected to said first and second legs for movement from a non-use position in which said third and fourth legs are substantially parallel to said first and second legs, to a use position in which said third and fourth legs make a positive angle with respect to said first and second legs and thereby provide a support base for supporting said tank for pivotal movement about the horizontal axis defined by said shaft stubs.

5. A system as recited in claim 4 wherein said discharge valve means are mounted adjacent said second end of said tank, and wherein said wheel means include axle means mounted adjacent said second face of said tank; and further comprising actuator means, including an actuator element, for said discharge valve means mounted adjacent said second end of said tank on the opposite side of said shaft stubs from said valve means.

6. A system as recited in claim 1 further comprising manually operated vent means for said tank located in said first face, and closed when said tank is in said second position so that when said tank is in said second position discharging liquid therefrom into a toilet, air may enter said tank only through said discharge valve means.

7. A system as recited in claim 6 further comprising anti-splash and toilet liquid level rise sensing means operatively associated with said discharge valve means.

8. A system as recited in claim 7 wherein said anti-splash and sensing means comprises a tubular element operatively connected to said discharge valve means and extending downwardly therefrom toward said toilet when said tank is in said second position thereof.

9. A system as recited in claim 5 further comprising latching means associated with said tilting means for releasably latching said tilting means to said tank in the first, non-tilting allowing, position.

10. A system as recited in claim 9 wherein said latching means comprises a hooked latching plate extending from at least one of said third and fourth legs toward said axle means, and being shaped and dimensioned to engage said axle means when in said first position, and to disengage said axle means when in said second position.

11. A system as recited in claim 1 further comprising handle means provided on said second end of said tank for facilitating movement of said tank with said wheel means, and tilting of said tank about said horizontal axis.

12. A tank system comprising:

a generally parallelepiped shaped tank having first and second opposite ends, and first and second opposite major faces and first and second opposite minor faces extending between said first and second ends;

wheel means operatively mounted to said tank adjacent said first end thereof;

handle means associated with said tank adjacent said second end thereof;

discharge valve means provided in said first major face and adjacent said second end of said tank for selectively allowing of preventing discharge of liquid from the interior of the tank to the exterior thereof; and actuator means for said discharge valve means including an actuator element mounted adjacent said first end of said tank, remote from said discharge valve means.

13. A tank system as recited in claim 12 wherein said actuator means is operatively mounted on said first major face and wherein said wheel means comprises axle means mounted to said second major face.

14. A tank system as recited in claim 12 further comprising stub shafts extending outwardly from opposite central portions (between said first and second ends of said tank) of said first and second minor faces.

15. A tank system as recited in claim 14 further comprising collar means connected to said stub shafts, and deployable support legs integral with said collar means extending from said collar means toward said first end of said tank; and latching means for releasably latching said support legs to said wheel means.

16. A tank system as recited in claim 15 further comprising manual vent means disposed in said first major face of said tank, and which are closed during discharge of liquid from the tank and open during filling of the tank with liquid.

17. A tank system as recited in claim 16 further comprising a tubular element operatively connected to said discharge valve means and extending outwardly from said first major face a substantial distance, said tubular element having a free open end at the furthest point thereof from said first major face.

18. A tank system as recited in claim 12 further comprising a level indicator, said level indicator including a support collar mounted in said first major face of said tank, a float stem reciprocal in said support collar, and an indicating diaphragm; aid support stem connected to said diaphragm so that as said tank is filled with liquid said support stem moves said diaphragm to an upstanding position in which it is readily viewed to indicate that the tank is full.

19. A method of emptying a holding tank in a recreational vehicle or the like, and discharging the contents of the holding tank into a water closet or the like, utilizing a wheeled transportable tank having a discharge valve with actuator, and a deployable stationary support operatively connected to the transportable tank, comprising the steps of:

(a) filling the transportable tank with the contents of the recreational vehicle holding tank by opening the valve of the transportable tank and flowing the contents of the holding tank through it, and then closing the valve;

(b) wheeling the transportable tank, on its wheels, to a water closet or the like;

(c) at the water closet or the like, deploying the stationary support, so that it supports the transportable tank instead of the wheels;

(d) tilting the transportable tank with respect to the stationary support about a horizontal axis to move the discharge valve into a position just above the water closet or the like; and (e) actuating the discharge valve to allow the contents thereof to flow therethrough into the water closet or the like.

20. A method as recited in claim 19 wherein a vent is provided for the tank, comprising the further steps of—during the practice of step (a) opening the vent, and during the practice of steps (d) and (e) closing the vent.

21. A method as recited in claim 20 wherein the vent comprises the only mechanism, aside from a discharge valve, for air to enter the tank, and comprising the further step, during the practice of step (e), of automatically terminating discharge of liquid from the tank to the water closet or the like should the level of liquid in the water closet rise to a point that overflow might occur, and automatically minimizing splashing during the discharge of liquid from the tank into the water closet or the like.

22. A method as recited in claim 21 wherein said steps of automatically terminating flow of liquid from the tank into the water closet or the like, and minimizing splashing, are accomplished by providing a tubular element extending outwardly a substantial distance from said discharge valve means and having an open end at, or just above, the water in the water closet or the like.

* * * * *